US006502875B1

(12) United States Patent
Berry

(10) Patent No.: US 6,502,875 B1
(45) Date of Patent: Jan. 7, 2003

(54) DEVICE FOR ADJUSTING POSITION OF SHELVED MERCHANDISE

(76) Inventor: Carol Berry, 10676 Missouri #7, Los Angeles, CA (US) 90025

( * ) Notice: Subject to any disclaimer, the term of this patent is extended or adjusted under 35 U.S.C. 154(b) by 0 days.

(21) Appl. No.: 09/912,707

(22) Filed: Jul. 25, 2001

(51) Int. Cl.[7] ..... B25J 1/02
(52) U.S. Cl. ..... 294/27.1; 294/1.1; 294/15
(58) Field of Search ..... 294/1.1, 15, 19.1, 294/26, 27.1, 31.2, 49, 152, 156; 81/3.43

(56) References Cited

U.S. PATENT DOCUMENTS

| | | | | | |
|---|---|---|---|---|---|
| 1,035,088 | A | | 8/1912 | High | |
| 1,210,399 | A | * | 1/1917 | Bearce et al. | 30/429 |
| 1,308,654 | A | * | 1/1919 | Bopst | 294/15 |
| 1,384,176 | A | * | 7/1921 | Bartlett et al. | 81/3.43 |
| 1,420,546 | A | | 6/1922 | Hermelink et al. | |
| 1,426,387 | A | * | 8/1922 | Ives | 294/28 |
| 1,468,709 | A | | 9/1923 | Grandeur et al. | |
| 1,739,347 | A | * | 12/1929 | Benedict | 294/26 |
| 2,655,824 | A | | 10/1953 | Land et al. | |
| 2,676,831 | A | * | 4/1954 | Scuderi | 294/15 |
| 2,725,731 | A | * | 12/1955 | Stoltman | 294/15 |
| 3,186,749 | A | | 6/1965 | Dawes | |
| 3,211,489 | A | * | 10/1965 | Gill | 294/152 |
| 4,223,673 | A | | 9/1980 | Harris | |
| 5,056,843 | A | | 10/1991 | Johnston | |
| 5,531,495 | A | | 7/1996 | Hohman | |
| 5,695,230 | A | * | 12/1997 | Thompson | 254/131 |

* cited by examiner

*Primary Examiner*—Dean J. Kramer
(74) *Attorney, Agent, or Firm*—Don Erickson

(57) ABSTRACT

A shelf stocking device (10) includes two arms (12,14), each with a handgrip member (24) at one end and a linking member (16) interconnecting the other ends of the arms together. An alternative embodiment (36) is generally L-shaped and includes an elongated arm (38) with a cross-bar (40) extending away from one end of the arm (38).

7 Claims, 5 Drawing Sheets

DEVICE FOR ADJUSTING POSITION OF SHELVED MERCHANDISE

BACKGROUND

1. Field of the Invention

The invention relates generally to locating of merchandise generally on a horizontal surface such as a shelf, and, more particularly, to a device for adjusting the position of the merchandise on the horizontal surface for improving neatness of appearance and making the merchandise more readily accessible.

2. Description of Related Art

Many types of products (e.g., packaged, canned and bottled foodstuffs) are restingly arranged on horizontal surfaces of shelves where they are readily visible by a customer and frequently can be directly removed by a customer desiring to purchase the item. At other times the products are located behind counters where although they may be directly viewed by a customer, the assistance of a clerk is required to actually retrieve the products. In either case, the products are desirably arranged neatly and close to the front of the shelf surface so as to be easily seen by customers as they walk past.

Still further, as items are sold from a given shelf, they are typically removed from the front of the stacked or shelved products, leaving the remaining stored items recessed from the shelf front edge. Because of this, there is a constant procedure of replenishing products onto shelves as the stored products are sold. The difficulty of replenishing products to empty shelf space is increased the farther back one has to move a new product onto the shelf and how much adjusting of product arrangement has to be made. At the present time, maintaining stacked arrangement of products on shelves and adjusting for aesthetic arrangement is accomplished strictly manually.

SUMMARY OF THE INVENTION

In accordance with the practice of the present invention, a handheld device is provided which acts generally as an extension of the arms enabling controllably pushing, pulling or laterally moving products from one position to another to reposition stored products in predetermined files or rows and at a prescribed spacing from the shelf front edge. A plurality of products can be simultaneously adjustably moved and positioned as desired. Depending upon circumstances, the device may be employed by manipulation using one hand or two.

BRIEF DESCRIPTION OF THE DRAWING

These and other objects of the present invention will become more readily apparent upon reading the following detailed description and upon reference to the attached drawings in which.

DESCRIPTION OF A PREFERRED EMBODIMENT

Figure 1:
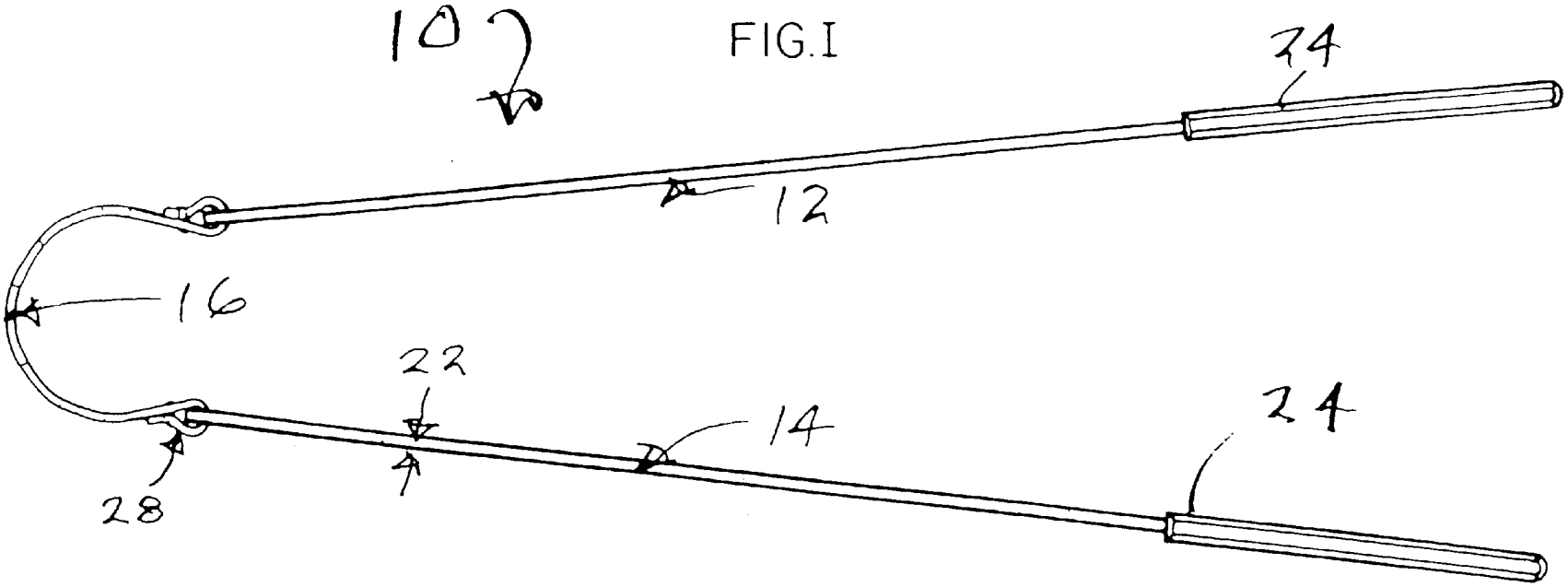
FIG. 1 is a plan view of the device of this invention.
Figure 2:
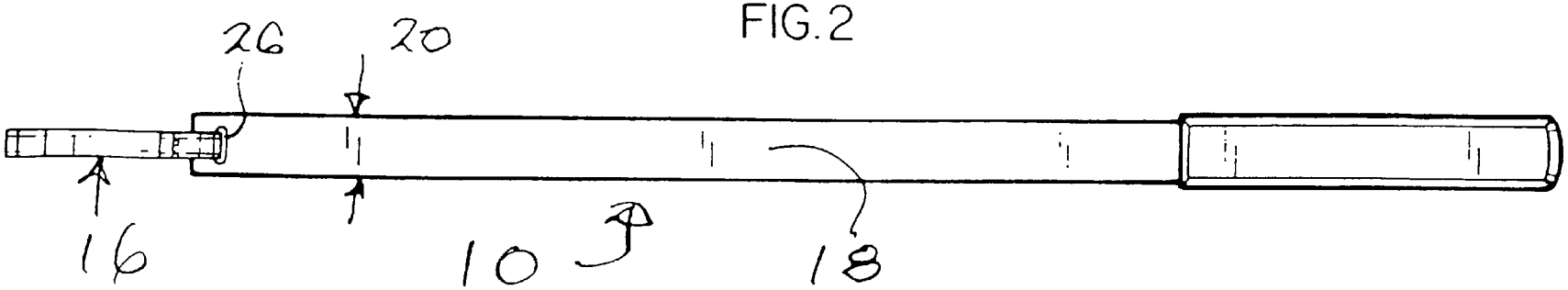
FIG. 2 is an elevational view of the device of FIG. 1.

Turning now to the drawings and particularly FIGS. 1 and 2, the device of the present invention enumerated generally as 10 is seen to include two arms 12 and 14 interconnected by a linking member 16 at one end of the arms with the opposite end of the arms being free and capable of being separated from one another. Each arm includes an elongated, generally rectangular cross-section member 18 of a rigid material (e.g., steel) which preferably possesses substantial rigidity against flexing. Although other materials may be found satisfactory, practical constructions of the invention having ribbons 18 made of a stainless steel that will retain its original has been found to provide excellent results.

The outer or free end of each arm 12, 14 includes a handgrip member 24 secured thereto constructed to facilitate gripping by hand or with the fingers without having the edges of the ribbons 18 bite into the hands or fingers during use. Excellent results have been achieved by providing members 24 made of rubber or a synthetic plastic material that is relatively soft to the touch. Preferably the members are of such relative size that they will be frictionally secured in place on the members 18 or, alternatively, the members may be heat softened during application to increase adhesive securement thereon, or an adhesive material may be used (e.g., epoxy).

The linking members 16 are preferably constructed of a length of textile material that is highly flexible and capable of conforming about an object in an intimate surface contacting manner. The opposite end portions of the linking members are received through slotted openings 26 located in an end of each member 18 and then formed into a locking loop at 28 (e.g., by sewing). Alternatively, linking members can be constructed of leather, a pliable plastic, rubber, or a length of rope or cord, all in a strip form and the loops formed by folding the end portions back on themselves and securing by use of an adhesive, rivet or other such means.

Prior to the described invention, employees in a store engaged in so-called stocking of shelves of products provided in jars or similar shaped containers have had to insert their hands and arms between rows or files of such products in order to locate new products behind older products or to merely adjust product rows and files for aesthetic and functional purposes. Otherwise, the employees had to physically remove the older products from the shelves in order to place the newer products to the back, all of which was time consuming and difficult. Now, however, this task can be accomplished with the use of the described device more efficiently and simply.

Figure 3:
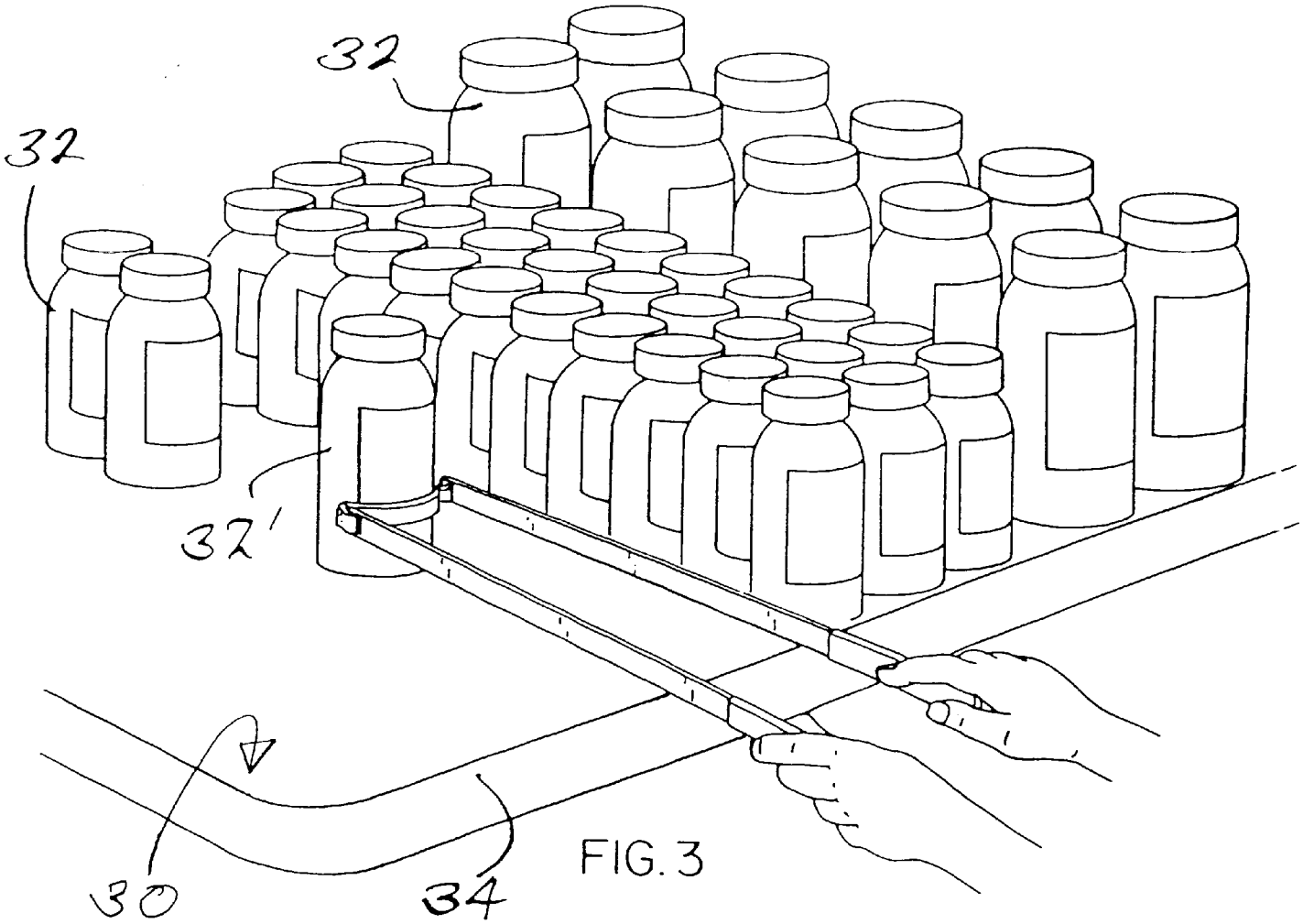
FIG. 3 is a perspective view of a shelf stocked with products in bottle form shown with invention operating in pushing mode.

Turning now to FIG. 3, there is shown a shelf 30 on top horizontal surface of which there are positioned a plurality of glass, metal or plastic containers 32 desirably arranged in neat rows extending from a front edge 34 rearwardly. In accordance with a pushing mode of use, the device 10 is held with one gripping member in each of the two hands and urged forwardly against a container 32' desired to be moved such that the linking member 16 conforms about a lateral surface of the member. Application of a pushing force against the container 32' causes it to slide rearwardly to a new position, as desired.

Figure 4:
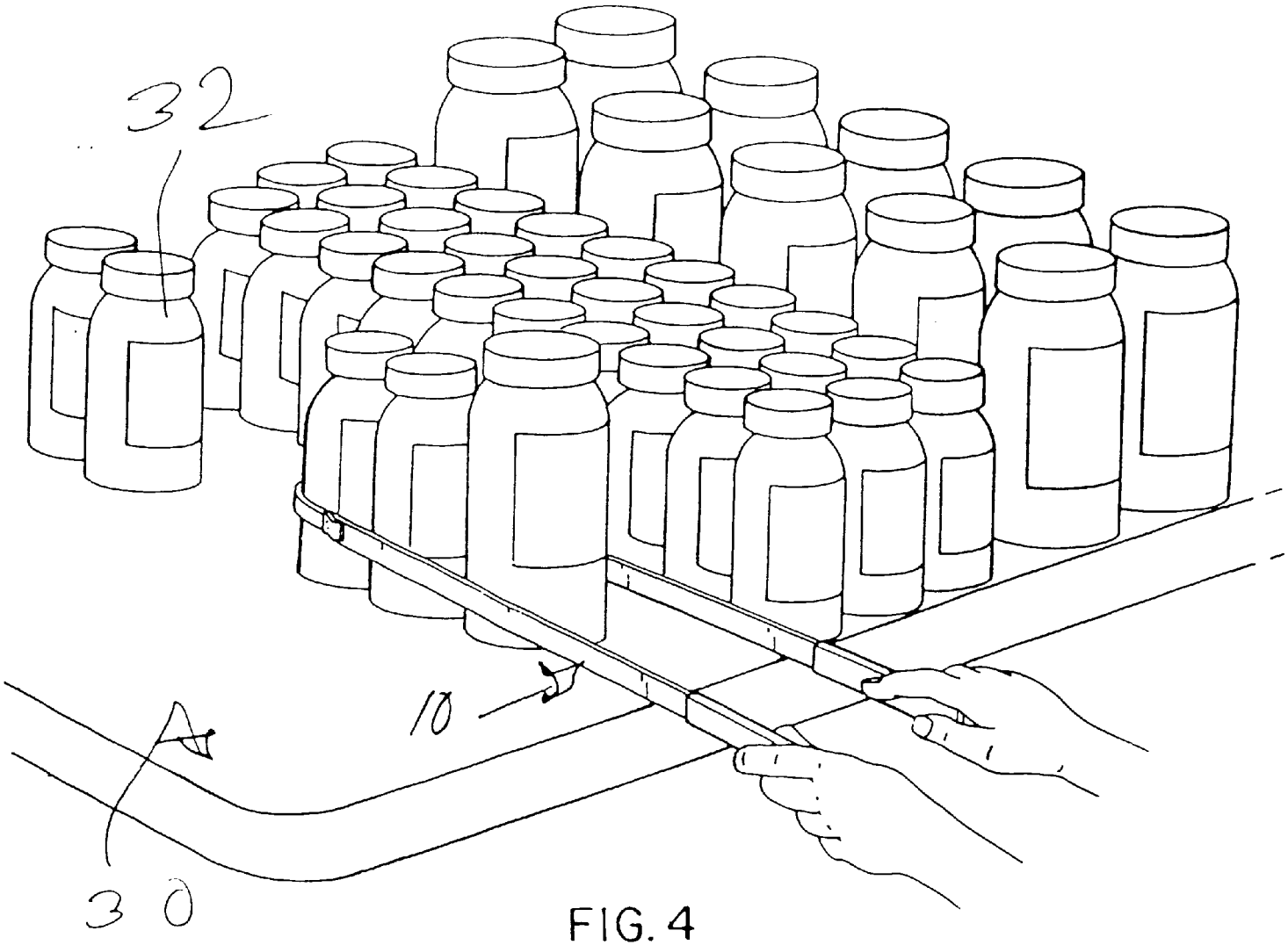
FIG. 4 is a perspective view showing the described device adjustably moving a plurality of products at one time in pulling mode.

For the ensuing description of use of the device 10 in a pulling mode, reference is now made to FIG. 4. Assuming that it is desired to adjustably position three containers forwardly, the linking member 16 is placed behind the rearmost container and conformed about that container's side surface. The two side arms are then brought into contact with the sides of the containers (or very close to contact), following which application of a pulling force on the device repositions the three so-gripped containers. Although described to reposition three containers it is to be understood that depending on the container sizes, more than three containers may be simultaneously repositioned, and all of one container size or more than two container sizes. It is important to note that as the containers are repositioned as shown in FIG. 4, they are maintained in a line and deposited at a new position in a precise line, oriented as desired.

Figure 5:
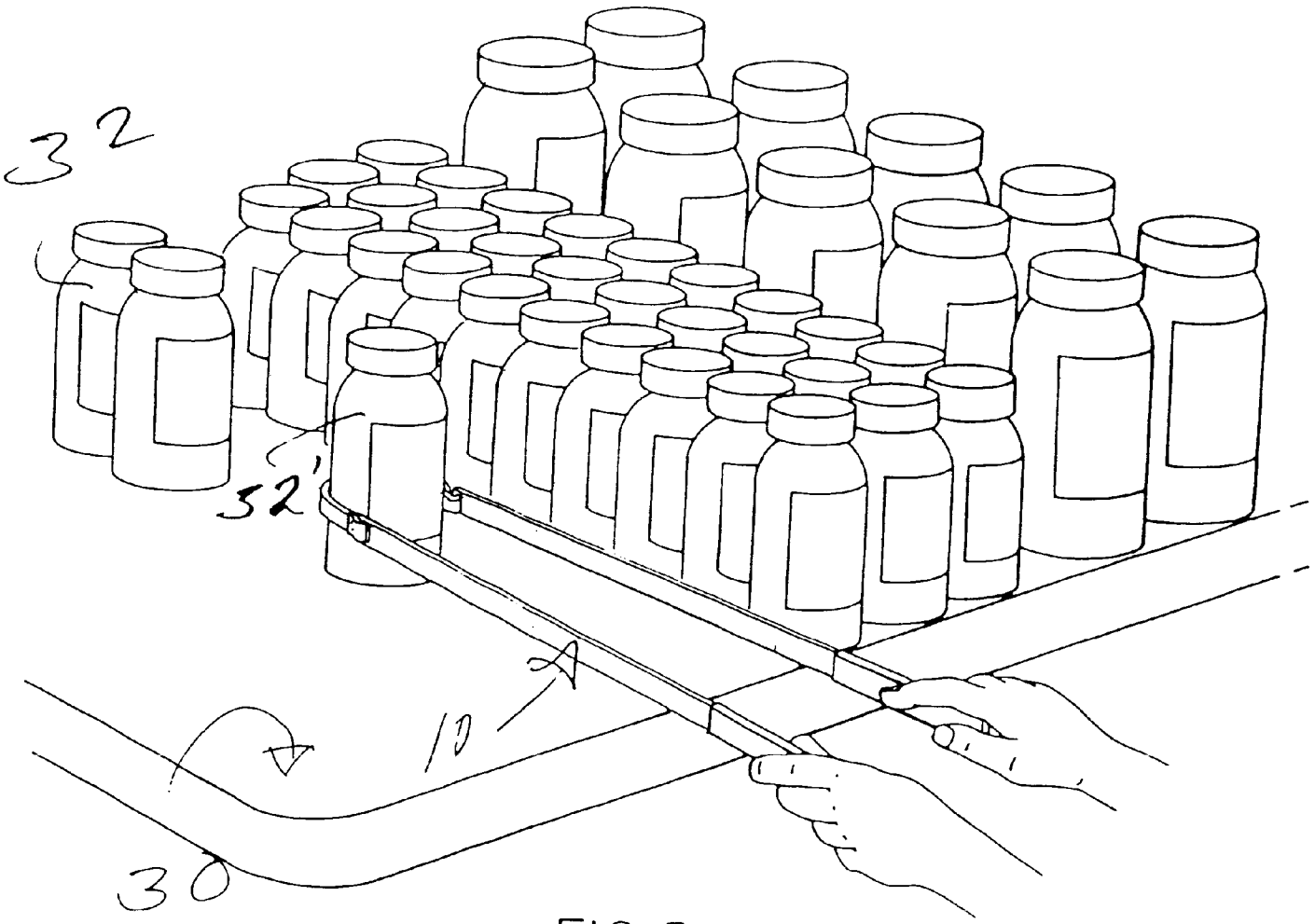
FIG. 5 is a further perspective view similar to FIG. 4 showing the invention being used in pulling mode for a single product.
Figure 6:
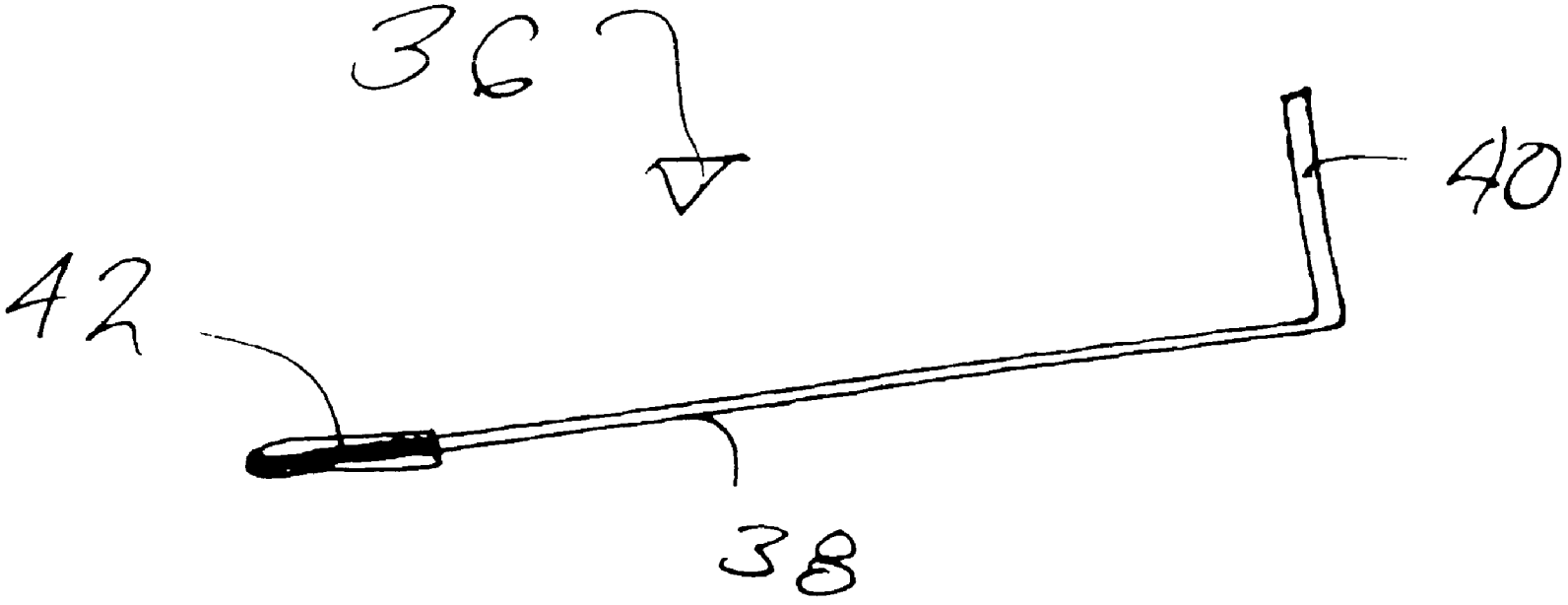
FIG. 6 is a plan view of a further embodiment of the invention.

An alternative embodiment of the invention is depicted in FIG.5 enumerated as 36. As shown, the device 36 is generally L-shaped with an elongated arm 38 and a cross-bar 40 secured to extend preferably at 90-degrees from what is an outer end of arm 38 during use. A handgrip member 42 may be provided to the other end of arm 38 and may be constructed identically to the previously described handgrip member 24. In use, one or more containers 32 are trapped between the cross-bar and the arm enabling pulling repositioning or lateral pushing of the containers. If it is necessary to move the containers in a laterally opposite direction, the device is lifted up and the device arm is located on the opposite side of containers.

Utilization of the embodiments of the invention enhances the speed with which an employee can restock a shelf or straighten rows of stock even when adjacent rows are relatively close together. Also, since the person restocking a shelf is no longer required to insert hands and arms between rows, the shelves can be deeper and the product rows closer together, allowing for more efficient use of available shelf space. Moreover, when the described device is used this enables vertically adjacent shelves to be more closely spaced than would formerly have been the case.

Although the invention is described in connection with preferred embodiments, it is to be understood that one skilled in the appertaining art may contemplate modifications that come within the spirit of invention as described and within the ambit of the appended claims.

What is claimed is:

1. A method for slidingly positioning a plurality of items on a shelf surface on which they are restingly supported, the method comprising:

(a) positioning a first and second arms about the plurality of items on the shelf, the first and second arms sized to span the plurality of objects;

(b) aligning the plurality of items relative to each other; and wherein the first and second arms are constructed of a material sufficiently rigid to retain a predetermined shape, the first and second arms having first and second handgrip members respectively secured onto a first end portion of each arm, and a linking member constructed of a flexible, conforming to the touch material interconnected to a second end portion of each of the first and second arms.

2. The method of claim 1, in which each arm is of a generally rectangular cross-section and presenting a flat surface toward items stored on the shelf during use.

3. The method of claim 2, in which each arm is adapted during use to be handheld with the flat surfaces of the first and second arms are substantially parallel to one another.

4. The method of claim 1, in which the second end portion of each arm includes an opening, and an individual end portion of the linking member is passed through each opening and formed into a closed loop forming an interconnection therewith.

5. The method of claim 1, in which each handgrip member is constructed of a material selected from the group consisting of a synthetic plastic and rubber.

6. The method of claim 5, in which a handgrip member is secured onto an arm by frictional engagement therewith.

7. The method of claim 5, in which a handgrip member is secured onto an arm by an adhesive material.

* * * * *